United States Patent [19]

Daverio et al.

[11] Patent Number: 4,836,509

[45] Date of Patent: Jun. 6, 1989

[54] SUPPORT AND INTRODUCTION BENCH FOR AN ELONGATED RECTILINEAR PROBE, AND PROBE ADAPTED TO SAME

[75] Inventors: Jean-Claude Daverio, Ban-Saint-Martin; Dominique Rocchi, Piennes, both of France

[73] Assignee: Institut de Recherches de la Siderurgie Francaise, Maizieres, France

[21] Appl. No.: 112,376

[22] Filed: Oct. 22, 1987

[30] Foreign Application Priority Data

Oct. 29, 1986 [FR] France ..... 86 15074

[51] Int. Cl.[4] ..... C21B 7/24

[52] U.S. Cl. ..... 266/99; 266/226; 73/DIG. 9

[58] Field of Search ..... 266/271, 99, 79, 226, 266/269; 73/DIG. 9

[56] References Cited

U.S. PATENT DOCUMENTS

| | | | |
|---|---|---|---|
| 3,314,671 | 4/1967 | Heino et al. | 266/271 |
| 4,361,315 | 11/1982 | Kajihara et al. | 266/99 |

FOREIGN PATENT DOCUMENTS

| | | | |
|---|---|---|---|
| 679959 | 1/1930 | France . | |
| 2472018 | 12/1980 | France . | |
| 58-22312 | 1/1983 | Japan . | |
| 59-104408 | 6/1984 | Japan . | |
| 717136 | 8/1978 | U.S.S.R. . | |
| 722949 | 9/1978 | U.S.S.R. . | |
| 0591512 | 12/1978 | U.S.S.R. | 266/79 |

*Primary Examiner*—S. Kastler

*Attorney, Agent, or Firm*—Staas & Halsey

[57] ABSTRACT

The bench for supporting and introducing an elongated rectilinear probe in a blast furnace comprises probe supporting and guiding means and probe driving means, constituted by a carriage guided according to a translatory movement on rails. The probe is held in position on the carriage at the level of the rails so that the thrusting force exerted by the carriage on the probe in order to cause its penetration into the furnace, is applied in the axis of said probe. The means for guiding the probe comprise articulated arms which are retractable in order to clear the path followed by the carriage when the latter is moved toward the furnace.

20 Claims, 5 Drawing Sheets

SUPPORT AND INTRODUCTION BENCH FOR AN ELONGATED RECTILINEAR PROBE, AND PROBE ADAPTED TO SAME

BACKGROUND OF THE INVENTION

1. Field of the Invention

The present invention relates to a support and introduction bench for an elongated rectilinear probe, of the type used for carrying out samplings in smelting-reducing furnaces such as blast furnaces. The invention further relates to a probe adapted to be used with such a bench.

2. Description of the Related Art

Benches are generally known and used in apparatuses for probing through an orifice provided in the wall of the furnace. Such probing apparatuses normally include means for tightening and/or guiding the probe, which are joined to the furnace wall, as well as means for introducing the probe. Often, the probe is introduced into the furnace by exerting a thrust force at the level of its rear end.

In certain cases, the probes can be very long and have a small diameter (for example 13 m long for 90 mm diameter) thus it is important for the probes to be supported between the guiding device close to the furnace and the introduction device, in order to prevent bending. To this effect, there has been is provided substantially in the axis of the introduction orifice made in the wall of the furnace, a bench of length adapted to the length of the probes and equipped with means for driving the probe according to a translatory movement along its axis, as well as support and guide means distributed along the length of the bench.

A bench of this type is described in patent document FR-2 472 018. According to this document, the bench is composed of a frame forming two parallel rails for guiding a probe-holding carriage which holds the rear end of the probe and which is designed to drive it according to a translatory movement and to transmit thereto the force necessary to its penetration into the furnace. The carriage itself is moved by means of chains connected to a driving member and comprises driving rollers which are engageable in the guide rails of U-shaped cross-section. Support and guide arms designed to prevent or limit any bending and buckling of the probe, are secured at regular intervals on the bench and their ends, situated above the probe, comprise guiding clamps encircling the probe. Said clamps have a part which is fixed with respect to the arm, and another part which is articulated thereon and which is pivotable upward to allow positioning of the probe on the bench. A free space is provided between the lower ends of the two parts of the clamp to allow the passage of the lugs securing the probe on the carriage during the translatory movement of the latter.

The securing lugs provided on the probe are therefore relatively thin and extend on only one side of it in order to be connected on fastening brackets provided on the carriage.

The probe axis is then offset upwardly with respect to the horizontal median plane of the carriage, hence with respect to the median plane of the carriage guide rails.

It has been found that, although this disposition may be suitable when the probe penetration force is low, it presents on the other hand, serious disadvantages as soon as the resistance to the penetration increases. Indeed, due to the position of the probe axis above the horizontal median plane of the guide rails and of the offset position of the probe with respect to the point of application of the pulling force exerted by the chains on the carriage, resistance of the probe to penetration causes a tilting moment for the carriage, which tends to raise its front part, and which creates a bracing of said carriage in the rails, thereby increasing the friction and tending to draw the flanges of the guide rails apart and to deform them.

As a result, the probe end which is held on the carriage also tends to move angularly from the theoretical axis of penetration, this contributing to causing buckling which in turn tends to increase the bracing phenomenon. This problem is further emphasized by the play which exists between the rollers of the carriage and the rail.

In addition, the guide arms are permanently situated above the probe and interfere with the positioning of said probe on the bench. Moreover, the clamps only grip the probe laterally at two diametrically opposite points of the probe, without forming an abutment above it, buckling tends to bend the probe upwardly, and hence to jam it between the two parts of the clamps.

To understand the importance of the arising problems, it should be noted that in the case of a probe of 90 mm diameter, the force required to introduce it inside a blast furnace can reach 80 kN, and for a sampling probe of 300 mm diameter, the force is near 250 kN.

SUMMARY OF THE INVENTION

It is an object of the invention to solve the different problems referred to hereinabove.

Another object of the invention is to provide a bench for introducing a probe into a furnace such as a blast furnace, which permits a reduction of the stresses created on such a bench by the application of a high compression force on the end of a long probe of small diameter.

Yet another object of the invention is to propose a bench easy to use both in the preparation and carrying out of the sampling operation.

These objects are reached with a bench for supporting and introducing an elongated rectilinear probe into a furnace along a direction parallel to its axis, comprising means for supporting and guiding the probe, and driving means guided according to a translatory movement on the bench by longitudinal guide rails parallel to the axis of the probe, and designed to make the probe penetrate into the furnace.

According to the invention, this bench is characterized in that the probe is held in the driving means at the level of the longitudinal axis of symmetry of said rails, and in that the thrusting force is applied by said driving means to the probe in the axis of the latter.

The main advantage of the bench according to the invention is that the thrusting force is transmitted by driving means to the probe in the axis thereof and as a result the stresses liable to increase buckling of the probe are strongly reduced, as well as the stresses tending to cause bending of the bench.

Another advantage is that the carriage which constitutes said driving means has no tendency to camber and therefore does not exert any stray pressures on the slideways perpendicularly to the latter.

Yet another advantage of the invention is that the causes of the buckling being reduced, the probe supporting and guiding means are less strained and are subjected to less stresses.

According to an advantageous feature of the invention, said probe supporting and guiding means can be retracted out of the path followed by the carriage. In this way, they support and guide the probe upstream of the carriage, and by being retracted, they clear completely the way for said carriage when the latter is moving towards the furnace. The means for joining the probe to the carriage can then be of large dimensions, hence be more rigid and stronger.

In order to keep a perfect hold on the probe, each supporting and guiding means comprises three supporting and guiding members, one being placed under the probe, and the other two symmetrically on each side and above it, so that said members are distributed on the periphery of the probe.

According to another advantageous feature of the invention, the lower supporting member is carried by a retractable arm, and the upper supporting and guiding members are carried by levers articulated on the retractable arm. In this way, the upper members can be moved away from the probe and from each other in order to allow the retraction, beneath the bench, of the arm, of the levers and of the guiding members that they carry.

BRIEF DESCRIPTION OF THE DRAWINGS

The invention will be more readily understood on reading the following description of a preferred embodiment of a bench with associated probe according to the invention, with reference to the accompanying drawings, in which.

DESCRIPTION OF THE PREFERRED EMBODIMENT.

Figure 1:
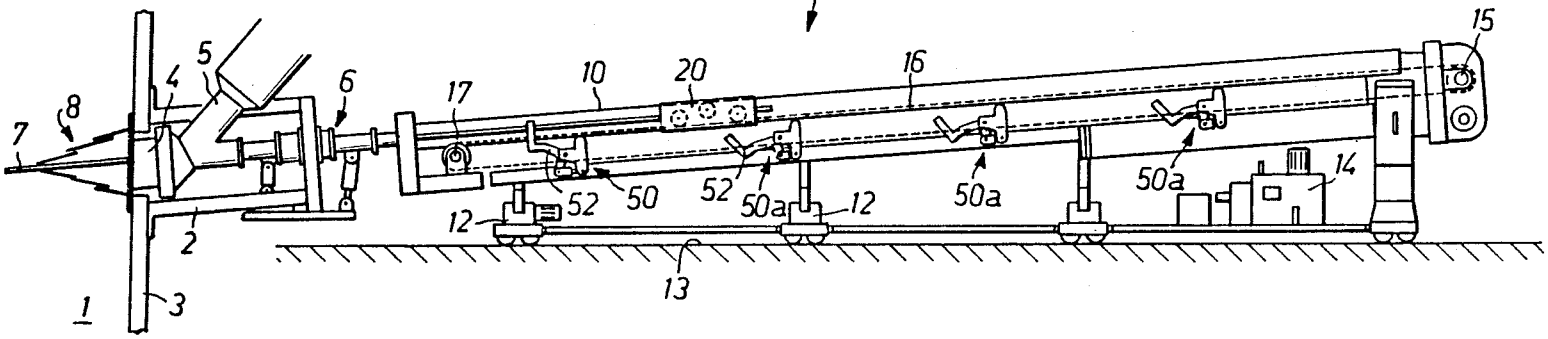
FIG. 1 is a side view of a bench for introducing a probe into a blast furnace.

Referring first to FIG. 1, this shows, as a whole, a device for probing in a blast furnace 1. Said device comprises tightness and guiding means constituted by a chassis 2 fixed on the jacket of a blast furnace 1 close to a tuyere 4 for injecting a blast into the furnace, said blast being brought into the tuyere 4 through a blast pipe 5. The chassis 2 carries tightness and guiding members 6, connected to the outer end of the tuyere 4, said members allowing the passage of a probe 7 when said probe is introduced into the blast furnace through orifice 8 of the tuyere 4.

The bench 9 for introducing the probe 7 comprises a chassis 10 provided with two guide rails 11, of U-shaped cross-section, the insides of which are in facing relationship, forming a running track for the probe-holding carriage 20. The chassis 10 of the bench is joined to chassis 2 carrying the tightness and guiding members 6, via adjustable and dismountable systems, not shown, which transmit the stresses exerted on the bench to the chassis 2, hence to the blast furnace jacket 3. The chassis 10 is furthermore supported by carriages 12 of adjustable height which are movable on the working table 13.

The bench 9 further comprises a hydro-electric generator 14 supplying the motor 15 driving the chain 16 of which the ends are fixed to carriage 20 in order to move same to and from the furnace. To this effect, a chain drive gear 17 is provided on the end of the chassis closest to the furnace.

Chassis 10 also supports means 50, 50*a* for supporting and guiding the probe, which means are constituted by arms retractable under the chassis 10 in order to clear the path for carriage 20. In FIG. 1, arm 50 is shown in the position of guiding probe 7 and arms 50*a* are shown in retracted position.

As clearly illustrated in FIG. 1, the probe 7 is secured on the carriage 20 in such a way as to be absolutely level with the longitudinal axes of said carriage 20 and of rails 11.

The carriage 20 driving the probe 7 and the means for fixing said probe thereon are described hereinafter in details, with reference to FIGS. 2 and 3.

Carriage 20 is composed of a frame 21 carrying on each side a set of three rollers 30, 31 engageable in the rails 11. The two end rollers 30 of each set, situated frontwards and rearwards of the carriage, rest and run on one flange, preferably the lower flange, of rail 11. The position of the axes of these end rollers is fixed with respect to the carriage. The third rollers 31 of each set are situated in an intermediate position, preferably halfway between the two rollers 30 on each side of the carriage, and the position of their axes is adjustable heightwise with respect to the carriage so that they can be brought in contact with the other flange of rails 11, as illustrated on the righthand side of FIG. 3. The position of intermediate rollers 31 is adjusted by means of an adjustable eccentric bearing 32 carrying the shaft 33 of roller 31.

This particularly advantageous disposition contributes to eliminating any vertical play between the carriage 20 and the rails 11, thereby eliminating a serious reason for the probes to buckle, as already indicated hereinabove.

The probe 7 is supported on the carriage 20 in a cradle formed by one or more yoke pieces. In the device illustrated in FIG. 2, one yoke piece 22 is placed on each end of carriage 20.

The top part of the figure shows a system for securing a probe 7 of 90 mm diameter, whereas the lower part shows a system for a probe 7*a* of 300 mm diameter. As illustrated in FIGS. 2 and 3, the yoke piece 22 is identical, whatever the diameter of the probe and is so dimensioned as to directly receive the probe of larger mediate yoke pieces 40 adaptable in grooves 24 provided in yoke piece 22 level with the housing 25 provided in said yoke piece to support a probe of larger diameter.

Yoke piece 22 is in fact constituted by a girder forming the yoke piece base 23 and joining up the two sides of frame 21, and the housing 25 for the probe 7*a* of larger diameter is formed in said base 23 in such a way that the axis of said probe is substantially level with the shafts of rollers 30. Said housing 25 is in fact a semi-cylindrical recess of axis parallel to the rails 11 and situated inside the mean plane thereof and at equal distance therefrom. The front 26 and back 27 faces of base 23 of the yoke piece are vertical and parallel and receive the flanges 71, 72 integral with the probe 7*a*. and separated by a distance equal to the thickness of base 23. In this way, probe *7a* is locked in position axially on the carriage and the penetration or withdrawing force is transmitted from the carriage to the probe via the yoke piece 22 and flanges 71, 72. Probe *7a* is also held in position in its housing 25 by a cap 28 articulated on the base 23 via a pivot pin 29. Said cap is provided with a recess which is similar or complementary to the recess formed in the base 23 to constitute the probe housing 25, such that the two recesses of the base and of the cap form a bore adapted to receive the probe and to hold it in without play. Said cap 28 is thus hinged down over the probe *7a* between flanges 71, 72 and its end opposite to articulation 29 is fixed on base 23 by a pivot pin 35.

Figure 2:
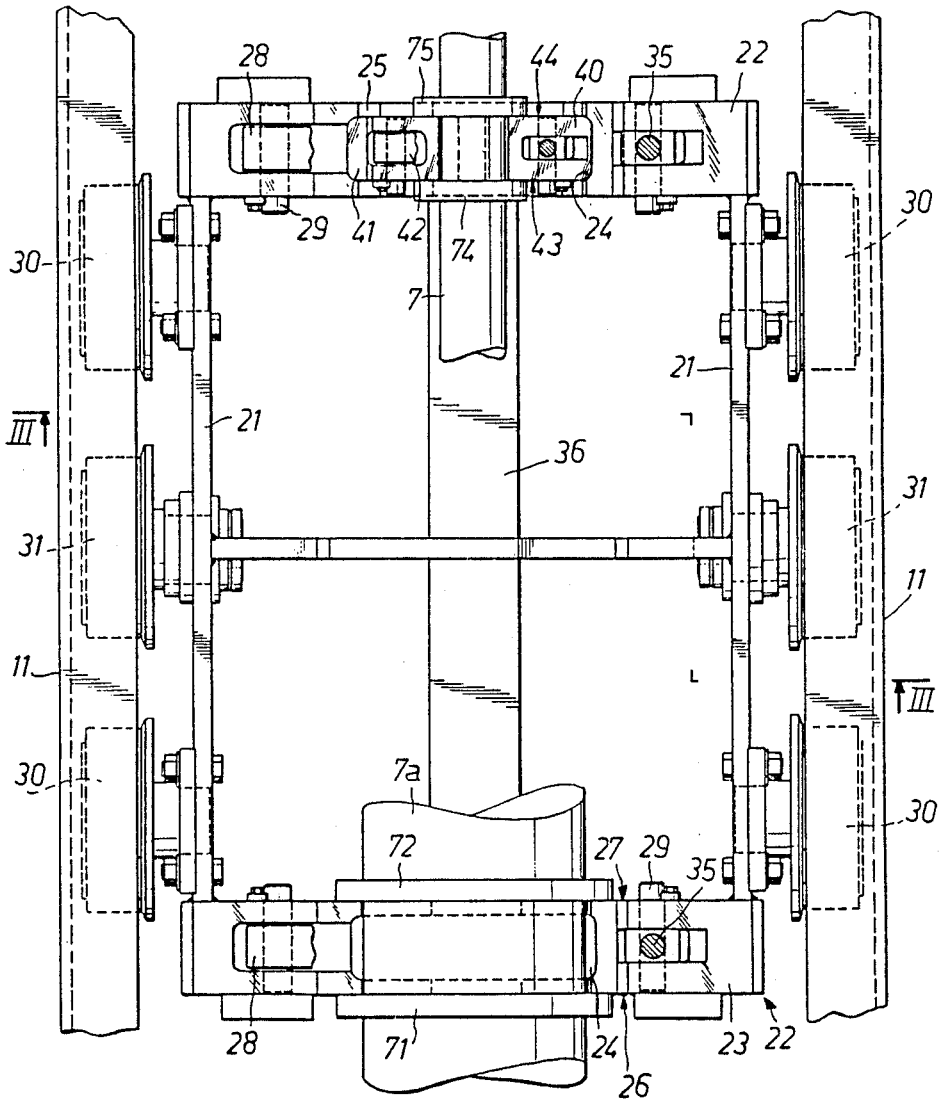
FIG. 2 is a detailed plan view of the probe-holding carriage and of the rear end of the probe, showing the means used for joining the probe to the carriage.

In FIG. 2, the caps 28 are not shown in full, only their ends articulated on pivot pin 29 can be seen.

Figure 3:
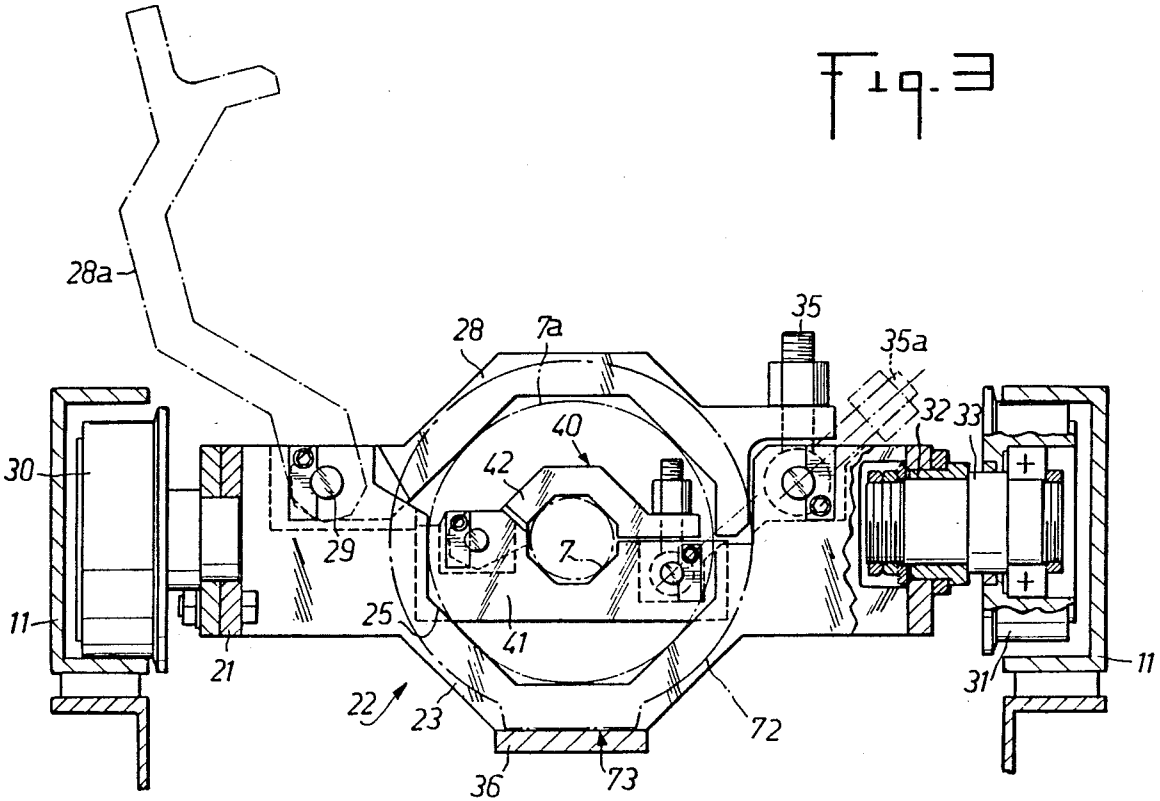
FIG. 3 is a partial cross-sectional view along line III—III of FIG. 2 of the carriage, taken along the probe axis.

FIG. 3 also illustrates in dot-and-dash lines and with the references 28*a*, 35*a*, the cap 28 and the pivot pin 35 in their open position for receiving or withdrawing the probe. It is therefore obvious that, in order to position the probe, said probe is simply placed over the yoke piece 22, after lifting up and tilting back the cap 28, and is allowed to drop into its housing 25 where it is automatically centered. It is also provided that at least one of the flanges of the probe comprises a flat surface 73 which, by coming into contact with a lower plate 36 of the cradle joining up the yoke pieces 22, immobilises the probe in rotation.

The top part of FIG. 2 shows a system for fixing a probe of small diameter. This system consists in a removable intermediate yoke piece 40 which is also provided with a base 41 and with a cap 42 joined to base 41 in the same way as in the main yoke piece 22. Said intermediate yoke piece 40 is vertically slidable in the grooves 24 formed on each side of housing 25 in base 23 of yoke piece 22. Similarly to the probe of large diameter, the probe 7 of small diameter is driven via flanges 74, 75 joined to the latter and resting against the faces 43 or 44 of intermediate yoke piece 40.

It is also possible to provide for a small probe, flanges of larger diameter and of appropriate relative spacing, which will then rest against the faces 26 and 27 of yoke piece 22. The advantage of such a disposition is that it transmits the penetration or withdrawal forces directly from the carriage to the probe. On the other hand, such a disposition implies greater overall dimensions.

Also, another particularly advantageous feature of the system with removable intermediate yoke is that it makes it possible to readily fix, on the same carriage, probes of different diameter, by using intermediate yokes adapted to the different probes. Obviously, those yokes will be so produced as to ensure that the axis of the probe is always kept in the same position.

Figure 4:
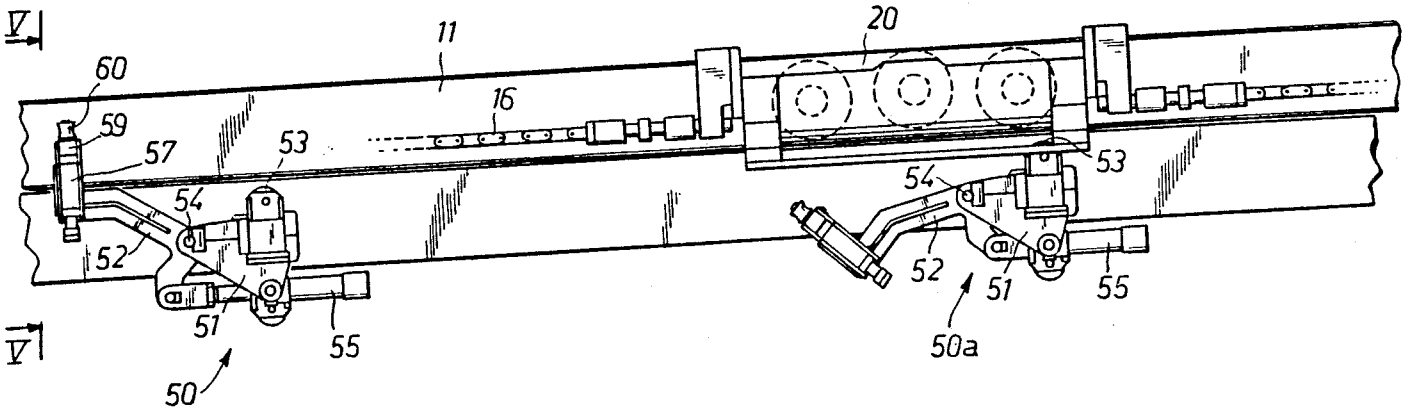
FIG. 4 is a detailed partial side view of the bench showing the arms supporting and guiding the probe.
Figure 5:
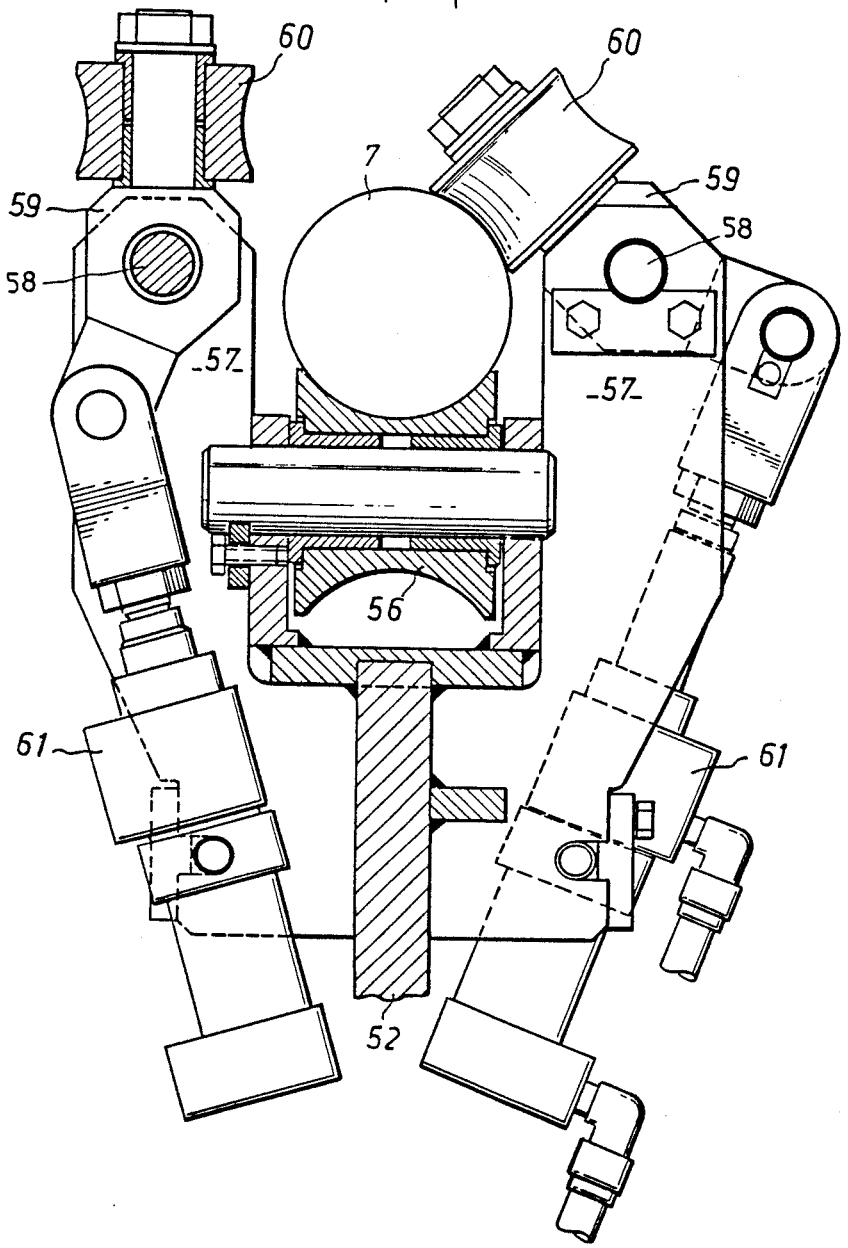
FIG. 5 is a detailed view of the end of the arms, taken along line V—V of FIG. 4.

FIGS. 4 and 5 illustrate the disposition and the constitution of the probe supporting and guiding means 50, 50*a*. Each one of these is constituted of a support 51 fixed on the chassis 10 of the bench beneath the rails 11, and of a retractable arm 52. Support 51 also carries rollers 53 designed to support the chain 16 driving the carriage 20. Retractable arm 52 is mounted for pivoting on support 51 about pivot pin 54 so that its end used for guiding and supporting the probe can be entirely retracted under the path followed by the carriage, when the arm is in low position, and said end is level with the probe when the arm is in high position. The means used for controlling arm 52 is a jack 55 of which the body is connected to support 51, and of which the end of the rod is mounted for pivoting on said arm 52. The end of the latter carries a supporting roller 56 mounted for free rotation about a horizontal axis situated inside a plane perpendicular to the probe axis and which is in position under the probe when arm 52 is raised and supports the latter in order to prevent it from bending downwardly. The end of arm 52 is shaped as a fork with two branches 57 between which is mounted supporting roller 56 and which extend on each side of the probe, when arm 52 is in high position as illustrated in FIG. 5. Each branch 57 carries a pin 58 on which is articulated a small lever 59 which also carries an upper roller 60 which rests on the probe at an angle of between 30° and 45° with respect to the vertical when said lever is controlled to a guiding position, and which is raised to a position such that its axis is substantially vertical when lever 59 is controlled to a clearing position either during the positioning or withdrawal of the probe, or to allow the retraction downward of arm 52. To do this, each one of the two levers 59 of an arm 52 is controlled by a jack 61 mounted for pivoting, on the one hand, on the end of arm 52 close to the fork 57, and on the other hand, on the ends of lever 59 which are opposite to rollers 60.

Obviously, the shafts of upper rollers 60 are situated inside the same plane, perpendicular to the probe axis, as the shaft of supporting roller 56, or at least inside a plane parallel and close thereto.

It is also conceivable that when the two upper rollers 60 are in their path clearing position, after pivoting upwardly away from the probe, the free space cleared between said rollers 60 must be sufficient to allow the passage of the probe of selected diameter when lever 52 is pivoted downward to be retracted.

Preferably, the lateral surface of rollers 56, 60 is concave, of radius equal to the radius of the probe so as to be in contact with said probe over a maximum part of its circumference.

The following is a description of the sequence of operations for positioning the probe on the bench and for introducing it into the furnace.

Before positioning the probe, carriage 20 is moved toward the back of the bench, that is, to the end thereof on the opposite side of the blast furnace. Caps 28, 42 of the yoke pieces are raised up and arms 52 are brought to the high position supporting the probe. Levers 59, on the contrary, are kept in their rest position, meaning that the upper rollers 60 are moved aside. The probe is then brought over the bench, it is lowered until it rests first on the rollers 56 of arms 52 and second in the yoke housings 25. Obviously, the probe is positioned axially so that flanges 71, 72, 74, 75 are respectively placed on either side of the yokes. Care must also be taken that the means used for stopping the probe in rotation are correctly oriented.

It will be noted that, because of the shape of bases 23, 41 of the yoke pieces, and because of the concave shape of the supporting rollers 56, the probe is automatically positioned in the target axis of introduction.

Caps 28, 42 of the yoke pieces are then pivoted down and tightened in order to hold the probe in position on the carriage 20, and levers 59 are actuated in such a way that upper rollers 60 are brought to rest on the probe. It will also be emphasized that because of the particular disposition of supporting rollers 56 and of upper rollers 60, the probe is firmly held on the arm 52 and that any efforts made to raise it are efficiently counteracted by upper rollers 60 due to their position above the probe.

The probing bench is then ready to commence the introduction of the probe. The motor 15 is started and exerts a pulling action on the chain 16 which, due to gear 17 pulls the carriage 20 towards the furnace. Arms 52 and levers 59 keep up their probe supporting position as long as they are upstream of the carriage 20. When said carriage 20 reaches close to an arm, a carriage-position sensor causes, first, the rollers 60 to move apart by a pivoting movement of levers 59, and then the retraction of arm 52 in order to clear the path for carriage 20. The same applies when the carriage reaches close to each one of the probe guiding means. In this way, the probe is permanently held between the front end of the bench and the carriage. As these guiding means are distributed regularly and sufficiently close to one another through the length of the bench, the probe cannot either bend or buckle when the penetration force increases.

To withdraw the probe, the process is used in reverse, so that the probe is always held along the introduction axis.

The invention is in no way limited to the description given hereinabove. On the contrary, the various guiding means, adjusting means, gripping means and control means of the various members can be modified in their design without departing from the scope of the invention.

What is claimed is:

1. Bench for supporting and introducing an elongated rectilinear probe into a blast furnace following a direction parallel to its axis, comprising:

a frame having two longitudinal guide rails, driving means guided according to a translatory movement on the bench by the longitudinal guide rails parallel to the axis of the probe, for moving the probe onto and out of the furnace, said driving means applying a thrusting force to the probe in the axis of the probe, and a plurality of support means connected to the frame at spaced intervals movable into a position for supporting and guiding the probe, each support means being retractable out of the supporting and guiding position when approached by the drive means.

2. Bench as claimed in claim 1, wherein the driving means comprise a carriage guided between the two guide rails, said carriage including a cradle formed by at least one driving yoke piece provided for gripping the probe circumferentially and for transmitting the thrusting force thereto.

3. Bench as claimed in claim 2, wherein each yoke piece comprises a base connected to the carriage and having a semi-cylindrical recess of axis parallel to the two guide rails, and being situated in the mean plane thereof half-way between said two guide rails, and a cap provided with a recess similar in shape to that of the base, said cap being fixed on said base in such a way that the two recesses form a bore for receiving and holding the probe.

4. Bench as claimed in claim 1, wherein the two guide rails are U-shaped and have two flanges, the insides of the two rails being in facing relationship, and the carriage comprises two sets of three rollers, two of which rollers rest against one flange of a rail inside the latter, whereas the third, which is placed in an intermediate position, is adjustable in position by way of an eccentric bearing so as to rest against the other flange of the rail.

5. Bench as claimed in claim 1, wherein each one of the retractable probe supporting and guiding means includes a retractable arm.

6. Bench as claimed in claim 5, wherein each one of the retractable probe supporting and guiding means includes three supporting and guiding members distributed over the periphery of the probe, one being placed under the probe and the other two symmetrically on each side and above the probe,

7. Bench as claimed in claim 6, wherein the supporting and guide members are rollers.

8. Bench as claimed in claim 6, wherein the lower supporting member is carried by the retractable arm and the two upper supporting and guiding members are carried by levers articulated on the retractable arm.

9. Bench as claimed in claim 8, wherein said arm and levers are actuated by jacks and the movement of said arms and levers is controlled as a function of the position and moving direction of the carriage on the bench, said arms and levers being retracted to a lower positioned when approached by the carriage.

10. Bench as claimed in claim 1, wherein said probe is provided towards its rear end with flanges for driving the probe according to a translatory movement perpendicular to the probe axis and resting against the front or rear faces of the yoke pieces of the carriage.

11. Bench as claimed in claim 10, wherein at least one of the flanges comprises means of immobilizing the probe in rotation on the carriage.

12. A probing device for probing a blast furnace having a jacket and a tuyere, comprising:

an elongated rectilinear probe movable into the blast furnace through the tuyere;

a chassis fixedly connected to the jacket of the blast furnace near the tuyere;

a bench connected to the chassis for supporting and guiding said probe and having two longitudinal guide rails parallel to the axis of said probe;

driving means for driving the probe into and out of the furnace and having a carriage guided and driven according to a translatory movement between said two rails of the bench, said carriage including a cradle formed by at least one driving yoke piece having front and rear faces and providing means for gripping said probe circumferentially and transmitting a penetration thrust force thereto from the driving means in an axis of said probe, said prob ®being provided near its rearward end with flanges which extend perpendicularly relative to the probe axis and abutting either face of said yoke pieces of said carriage; and a plurality of retractable probe supporting and guiding means, each including a retractable arm having supporting and guiding members distributed over the periphery of the probe, the movement of said arms being controlled according to a position and moving direction of said carriage on said bench.

13. A probing device as claimed in claim 12, wherein each said yoke piece includes a base connected to said carriage and has a semi-cylindrical recess which has an axis parallel to said rails, and a cap provided with a recessed shape similarly to the one provided in the base, said cap being positionable on said base in such a way that the two recesses form a bore for receiving and holding said probe.

14. A probing device as claimed in claim 12, wherein said two rails are U-shaped and have first and second flanges and an inside surface, the inside surfaces of the two rails opposing each other, said carriage including two sets of three rollers, two of which rest against the first flange of a rail inside the rail, the third roller being placed in an intermediate position relative to the other two rollers and is adjustably positioned with an eccentric bearing so as to rest against the second flange of the rail.

15. A probing device as claimed in claim 14, wherein each one of said retractable probe supporting and guiding means includes three supporting and guiding members distributed over a peripheral surface of the probe, one being placed under a probe and the other two symmetrically on each side and above the probe.

16. A probing device as claimed in claim 15, wherein said supporting and guiding members are rollers.

17. A probing device as claimed in claim 15, wherein the lower supporting member is carried by said retractable arm and the two upper supporting and guiding members are carried by levers articulated on said retractable arm.

18. A probing device as claimed in claim 15, wherein said arms and levers are actuated by jacks and the movement of said arms and levers is controlled in accordance with the position and moving direction of said carriage on the bench, said arms and levers being retractable to a lower position when approached by the carriage.

19. A probing device as claimed in claim 12, wherein at least one of said probe flanges comprises means for stopping said probe from rotating on said carriage.

20. Apparatus for probing a blast furnace with an elongated probe, insertable through a tuyere, comprising:

a probing device comprising a bench for supporting and guiding said probe and having two longitudinal guide rails parallel to the probe axis;

drive means for driving the probe into and out of the furnace and including a carriage guided and driven according to a translatory movement between said two rails, said carriage including a cradle formed by at least one driving yoke piece having front and rear faces and providing means for gripping said probe and transmitting a penetration thrust force thereto, wherein said probe includes flanges which extend perpendicularly relative to the probe axis which abut either face of the yoke pieces of the carriage.

* * * * *